US007192324B2

(12) United States Patent
Juestel et al.

(10) Patent No.: US 7,192,324 B2
(45) Date of Patent: Mar. 20, 2007

(54) METHOD FOR PRODUCING A SPARK PLUG ELECTRODE

(75) Inventors: Thomas Juestel, Hirschaid (DE); Heinz Ulm, Kunreuth (DE); Konrad Funk, Gundelsheim (DE); Martin Klassen, Ditzingen (DE); Jochen Fischer, Bamberg (DE); Andreas Benz, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 91 days.

(21) Appl. No.: 10/239,950

(22) PCT Filed: Dec. 22, 2001

(86) PCT No.: PCT/DE01/04927

§ 371 (c)(1),
(2), (4) Date: May 30, 2003

(87) PCT Pub. No.: WO02/060025

PCT Pub. Date: Aug. 1, 2002

(65) Prior Publication Data

US 2005/0176332 A1 Aug. 11, 2005

(30) Foreign Application Priority Data

Jan. 24, 2001 (DE) ..... 101 03 045

(51) Int. Cl.
*H01T 13/20* (2006.01)
*H01T 21/02* (2006.01)

(52) U.S. Cl. ..... 445/7; 445/64; 313/144

(58) Field of Classification Search ..... 445/4, 445/7, 60, 64; 313/141, 144, 118; 29/33 N
See application file for complete search history.

(56) References Cited

U.S. PATENT DOCUMENTS

| | | | | |
|---|---|---|---|---|
| 4,963,112 | A | 10/1990 | Benedikt et al. | |
| 5,448,130 | A * | 9/1995 | Matsutani et al. | 313/141 |
| 5,461,210 | A | 10/1995 | Matsutani et al. | |
| 5,607,605 | A * | 3/1997 | Musasa et al. | 219/121.64 |
| 5,736,809 | A * | 4/1998 | Matsutani et al. | 313/141 |
| 5,811,915 | A | 9/1998 | Abe et al. | |
| 6,147,441 | A * | 11/2000 | Osamura | 313/141 |
| 6,337,533 | B1 * | 1/2002 | Hanashi et al. | 313/141 |

FOREIGN PATENT DOCUMENTS

| | | |
|---|---|---|
| DE | 196 41 856 | 4/1997 |
| EP | 0 400 950 | 12/1990 |
| EP | 0 575 163 | 12/1993 |
| EP | 0 587 446 | 3/1994 |
| EP | 0 588 495 | 3/1994 |
| EP | 0 637 113 | 2/1995 |
| EP | 0 691 174 | 1/1996 |
| JP | 6045050 | 2/1994 |
| JP | 6188062 | 7/1994 |
| JP | 7073954 | 3/1995 |
| JP | 7296943 | 11/1995 |

* cited by examiner

*Primary Examiner*—Karabi Guharay
(74) *Attorney, Agent, or Firm*—Kenyon & Kenyon LLP

(57) ABSTRACT

A method of joining an electrode of a spark plug with a noble metal is described, the noble metal being joined locally with the electrode using a thermal input produced by a continuously operating laser beam.

14 Claims, 2 Drawing Sheets

METHOD FOR PRODUCING A SPARK PLUG ELECTRODE

FIELD OF THE INVENTION

The present invention relates to a method of joining an electrode of a spark plug with a noble metal.

BACKGROUND INFORMATION

Spark plugs having an electrode, e.g., a center electrode, a noble metal tip being applied to the front end of the center electrode or a noble metal being applied circumferentially in one area, have been known in the related art for a long time.

For example, European Patent No. 0 637 113 describes a spark plug having a center electrode having a heat resistant and erosion resistant nickel alloy, the front end of the center electrode being formed to have a noble metal tip of iridium or ruthenium. The nickel alloy has a thermal conductivity of approximately 30 $Wm^{-1}K^{-1}$ or greater. This printed publication states that the noble metal tip has a discoid shape and is arranged concentrically at the front end of the electrode metal.

The use of a YAG laser, for example, causes laser beams to be applied to the noble metal tip/front end boundary zone of the electrode metal, the noble metal tip being pressed against the front end of the electrode metal to which the noble metal is to be applied using a corresponding force.

A method of manufacturing a spark plug is known from European Patent No. 0 400 950, an iridium powder blank being manufactured which forms the firing tip of the center electrode of the spark plug. This iridium powder blank is sintered in a vacuum or in a non-oxidizing or reducing atmosphere and the firing tip is joined metallurgically to the front end of the center electrode. The metallurgic joining may be accomplished, for example, using electron beam welding or laser welding.

U.S. Pat. No. 5,811,915 and German Patent Application No. 196 41 856 also describe the provision of noble metal chips on a spark plug electrode such as, for example, a ground electrode or center electrode. According to these documents, the noble metal chips are applied using laser welding, specifically with the aid of an Nd:YAG laser.

European Patent No. 0 575 163 also describes welding a noble metal chip to a center electrode of a spark plug, the weld being located at the circumference of the boundary zone between the noble metal chip and the end face of the center electrode. A YAG laser is used for the welding in this case.

U.S. Pat. No. 4,963,112 also describes the attachment of a noble metal chip to an electrode of a spark plug, the attachment being made by laser welding. It is described that pulsed lasers are preferably used.

U.S. Pat. No. 5,461,210, European Patent No. 0 588 495 and European Patent No. 0 587 446 also describe the application of noble metal chips on spark plug electrodes. In this case also, a pulsed laser beam is always used to weld on the noble metal chips.

However, all of these methods known from the related art for applying a noble metal chip or another form of a noble metal to an electrode of a spark plug have in common that the application takes place with the aid of a pulsed laser.

In joining methods of this type with the aid of pulsed laser beam sources, the material to be joined, i.e., the electrode and the noble metal, are discontinuously melted and resolidified. This means that no continuous melt is produced.

The constant melting and resolidifying of the material to be joined may, however, make a thorough mixing of the fusion zone, i.e., a uniform alloy distribution, possible only to a limited degree. For that reason, a relatively high tendency to crack arises in the weld zone, for which reason the service life of such spark plugs, which are used as "long-life spark plugs," is ultimately limited by the relatively short fatigue endurance of the noble metal/electrode alloy join.

Frequently a nickel alloy is used as a material for the electrode. The joining using a pulsed laser beam results in undesirable alloy areas rich in nickel that are consequently less resistant to erosion and corrosion.

An observation of the surface of an electrode welded using a pulsed laser beam and provided with a noble metal shows that it is very irregular since it is not possible to produce a continuous fusion zone area but rather the material is repeatedly melted and solidified. Aftertreatment after welding may therefore be necessary.

SUMMARY OF THE INVENTION

In contrast, the proposed method of joining an electrode of a spark plug with a noble metal, a noble metal being melted locally onto an electrode using a continuously operated laser beam, has the advantage that the surface irregularities are reduced. At the same time, the method avoids cracks, pores, shrinkage cavities and fluctuations of the alloy components within the completely or at least partially melted zone, all of which weaken the noble metal/electrode material join. With a method of the present invention, it is thus possible to increase the service life of the component during operation since it is possible to avoid or at least minimize such weak points.

Since the uniform melting of the joined parts in the contact zone avoids the solidification cracks known with the use of pulsed laser beams, corrosion along such cracks is also avoided and a premature failure of the join is thus prevented. This is of particular importance when the spark plugs are used in the engine area.

In addition, the use of a continuously operating laser makes it possible to adjust the heating and cooling rate of the weld zone area to the particular materials and the type of the desired join, as a result of which a specific phase composition in the joining area is also attained.

Furthermore, a continuously operating laser also makes a wider variation in alloy compositions usable for the materials possible. The service life may therefore also be optimized through optimized alloy compositions for the materials and is not determined, as formerly, by a good or limited welding suitability for a pulsed laser.

Another advantage of the present invention is that the spectrum of weld zone geometries that may be obtained using a continuous laser beam is much broader than is the case with a pulsed laser.

In addition, it is possible to attain higher process rates, which results in a cost savings in manufacturing and a reduced thermal load on the component to be manufactured.

In summary, the overall result is an improved fusion zone between the noble metal and the electrode, which increases the service life of the electrode and consequently improves the function of the spark plug as a product.

According to a preferred embodiment of the present invention, the noble metal layer is applied to the electrode circumferentially in the form of bands of a specific width. Electrodes manufactured in this manner are used, for example, in surface gap spark plugs or air gap spark plugs.

According to an additional preferred embodiment of the present invention, the noble metal layer is applied to one face of the center electrode. However, when the noble metal layer is applied to the face of the center electrode, the noble metal component should preferably not be completely melted but rather only in its join area. This produces a spark plug electrode having a tip of wear-resistant noble metal.

If the noble metal is applied according to the present invention using a continuously operating laser beam, it is possible to use a diode-pumped laser in addition to an Nd:YAG or $CO_2$ laser.

According to the present invention the noble metal may be applied to an electrode in such a way that either it is completely melted and thus alloyed into the electrode or the noble metal is not completely melted but rather is only melted in its edge area and joined to the electrode in this edge area.

DETAILED DESCRIPTION

Figure 1:
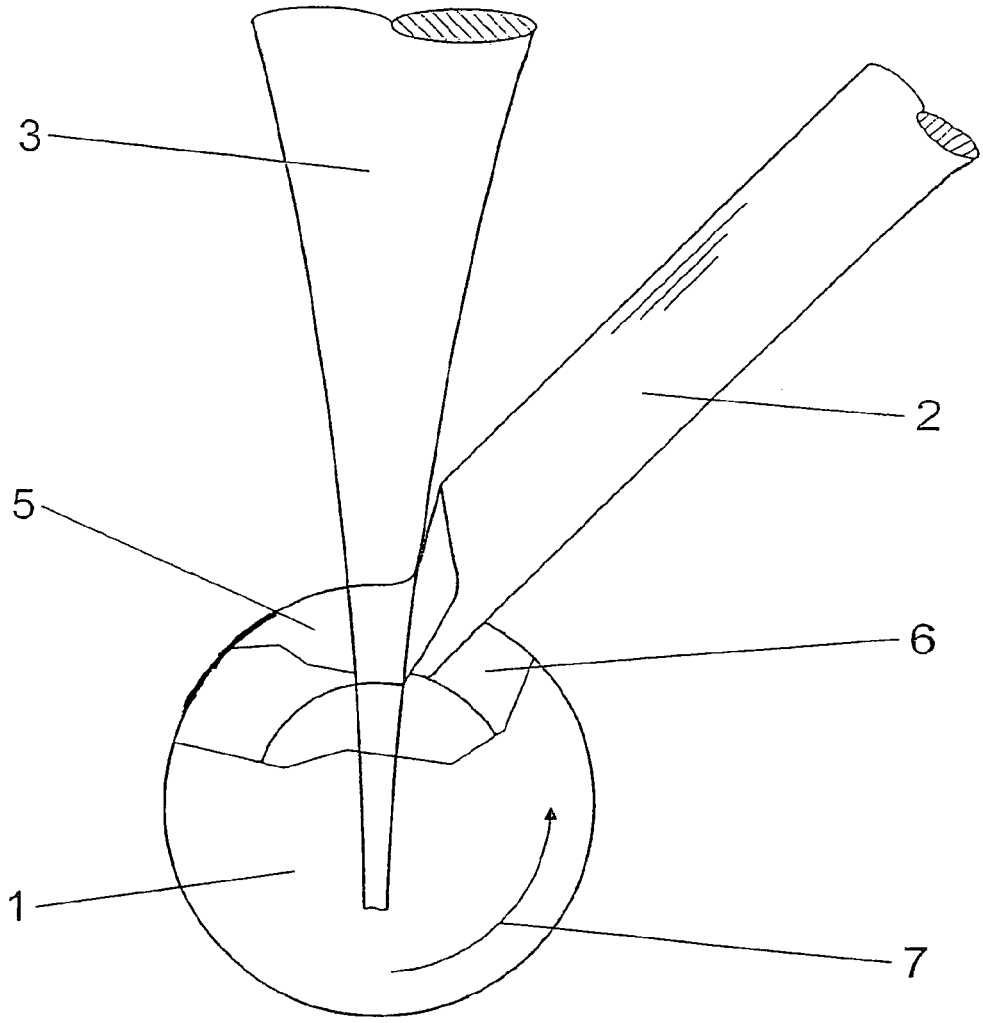
FIG. 1 shows a schematic depiction of a joining method in which a noble metal is fed to an electrode as a wire material.

A single-stage coating process of an electrode, i.e., a method of joining a spark plug electrode 1 with a noble metal 2, is shown by way of example in FIG. 1. According to the present invention, a noble metal 2 may be understood to be a pure noble metal or also any noble metal alloy which is suitable for the particular use.

FIG. 1 shows in particular a section through spark plug electrode 1, which in this case is a center electrode, which is filled with a molten noble metal 2 in the area of a preformed groove 6 and is used, for example, in a surface gap spark plug or an air gap spark plug. The section through center electrode 1 according to FIG. 1 is along groove 6.

According to the present invention, a continuously operating laser 3 is used for the melting, it being possible to use an Nd:YAG or a $CO_2$ or a diode-pumped laser, for example. A diode-pumped laser is suitable in particular since it is presently clearly more advantageous than an Nd:YAG or $CO_2$ laser with respect to acquisition and operating costs.

Noble metal 2, which in this case may be platinum, for example, is continuously fed as a wire material according to the preferred embodiment shown and is melted using continuously operating laser beam 3 in the area of preformed groove 6 onto center electrode 1 and is filled into groove 6 as molten mass 5 so that noble metal 2 is in effect wound onto electrode 1.

Simultaneously, the base material of center electrode 1 is also partially melted and an alloy is formed from the small amount of the molten base material of center electrode 1 and the material of noble metal wire 2.

This continuous manufacturing process of welding noble metal 2 brings about a homogeneous mixture of the fusion zone and consequently a uniform alloy distribution, resulting in increased service lives and a smooth surface of center electrode 1.

Moreover, it is possible to attain higher process speeds, again resulting in more cost-effective processing and a reduced thermal load on the component, i.e., center electrode 1.

The uniform temperature input over the weld zone area results in lower thermal stresses than in pulsed laser methods known from the related art and accordingly in an increased service life of center electrode 1.

The optimization of the surface quality is clearly visually discernible in the product. Micrographs also clearly show the improved weld zone, in particular in relation to the thorough mixing.

It is possible to adjust the heating and cooling rate, as a result of which the formation of cracks in the weld zone and the electrode base material is further prevented or minimized. Varying the heating and cooling rate also makes a wide variation of alloy compositions possible.

A manufacturing process for an additional electrode type, namely a top electrode is shown in 2A and 2B. A continuously operating laser beam (continuous wave or CW laser), preferably an ND:YAG laser, is used to weld the join between noble metal 2 and the nickel alloy of electrode 1'.

Figure 2A:
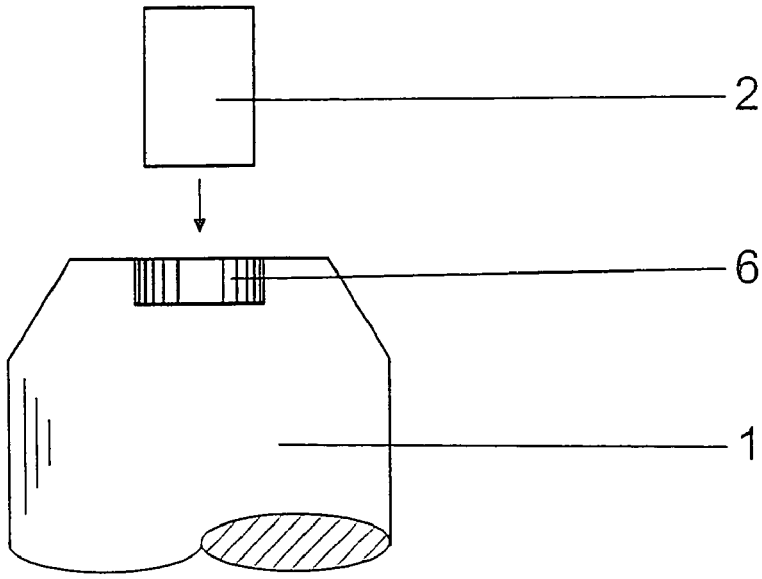
FIG. 2A shows a first schematic depiction of a method step of an additional method of joining a noble metal layer to an electrode in the manner of a top electrode.

As can be seen in FIG. 2A, a part made from noble metal 2, preferably in a cylindrical shape, is placed on or inserted into a recess 6 in a face of electrode 1', which here represents a center or ground electrode of a spark plug.

Recess 6 is preferably shaped out of the face of electrode 1' in such a way that when noble metal part 2 is inserted, it is fixedly joined with electrode 1'.

Figure 2B:
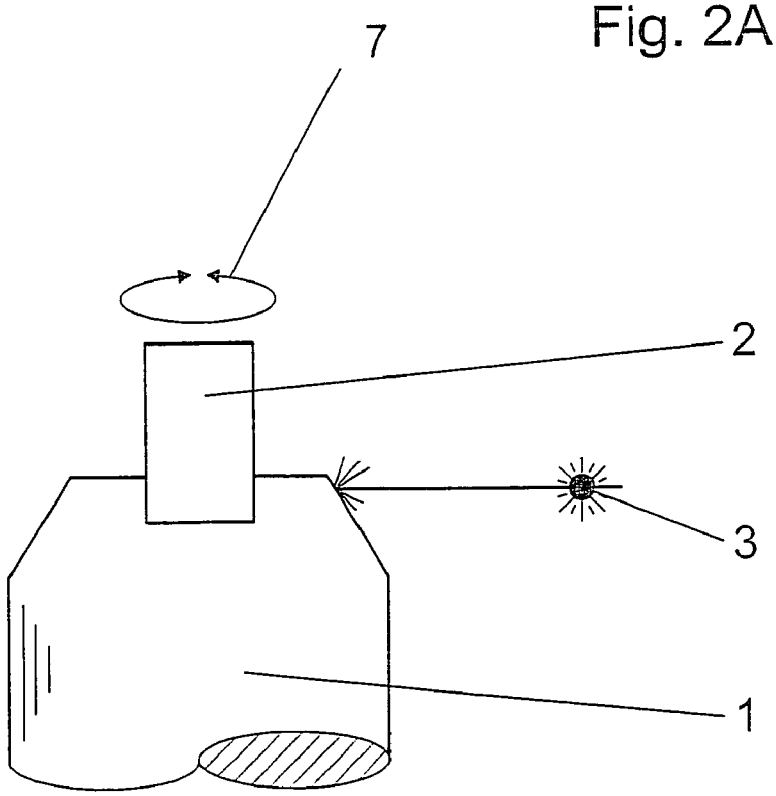
FIG. 2B shows a second schematic depiction of a method step of an additional method of joining a noble metal layer to an electrode in the manner of a top electrode.

As is evident in FIG. 2B, in a subsequent procedure step, the joined parts bonded in such a manner, namely noble metal 2 and spark plug electrode 1', rotate in the direction of arrow 7 at a speed adapted to the quantity of energy of a CW laser. Laser beam 3 is focused on the rotating zone to be welded and is switched on and off again corresponding to an energy gradient adapted to the joined parts with respect to the melting point, the thermal capacity, etc.

The result is a spark plug electrode 1', the tip of which is made from a noble metal 2 or a noble metal alloy which is permanently joined to the nickel alloy of electrode 1' by a uniform fusion zone. In the case of an electrode 1' provided with a noble metal 2 in such a manner, known as a top electrode, noble metal 2 is not completely melted but rather only in its join area.

What is claimed is:

1. A method of joining an electrode of a spark plug with a noble metal, comprising:

producing a thermal input by a continuously operating laser beam;

locally joining the noble metal with the electrode using the thermal input;

joining the noble metal to the electrode in a connecting area; and directing the laser beam at the connecting area, the noble metal not being completely melted but only melted in the connecting area, wherein the laser beam operates continuously with respect to time.

2. The method as recited in claim 1, wherein:

the thermal input is produced by the continuously operating laser beam such that melting occurs at least in one boundary zone between the noble metal and the electrode.

3. The method as recited in claim 1, further comprising:

applying the noble metal to the electrode circumferentially.

4. The method as recited in claim 1, further comprising:

applying the noble metal to one face of the electrode.

5. The method as recited in claim 1, wherein:

the continuously operating laser beam is formed by one of an Nd:YAG, $CO_2$ laser and a diode-pumped laser.

6. The method as recited in claim 1, further comprising:

forming the noble metal as a wire;

feeding the noble metal to a groove preformed in the electrode; and melting the noble metal onto the electrode by the continuously operating laser beam.

7. The method as recited in claim 1, further comprising:

forming the noble metal as a cylinder;

placing the noble metal on a face of the electrode; and melting the noble metal by the continuously operating laser beam in a boundary zone area between the noble metal and the electrode.

8. The electrode as recited in claim 1, wherein:

the electrode includes a center electrode.

9. The electrode as recited in claim 1, wherein:

the electrode includes a ground electrode.

10. The electrode as recited in claim 1, wherein:

the electrode includes nickel.

11. The electrode as recited in claim 1, wherein:

the electrode includes a top electrode for one of a surface gap spark plug and an air gap spark plug.

12. The electrode as recited in claim 1, wherein:

the noble metal is uniformly alloyed into the structure at the connecting area.

13. The method as recited in claim 1, wherein the connecting area is melted in such a way that a homogenous intermixture of a melting zone, and thus a uniform alloy distribution, is generated.

14. A method of joining an electrode of a spark plug with a noble metal, comprising:

producing a thermal input by a continuously operating laser beam;

locally joining the noble metal with the electrode in a connecting area using the thermal input; and directing the laser beam at the connecting area, the noble metal not being completely melted but only melted in the connecting area, wherein the laser beam operates continuously with respect to time.

* * * * *